US006593072B1

(12) United States Patent
Royster, Jr.

(10) Patent No.: US 6,593,072 B1
(45) Date of Patent: Jul. 15, 2003

(54) TABULAR GRAIN SILVER HALIDE EMULSION WITH UNIFORM EPITAXIAL DEPOSITION

(75) Inventor: Tommie L. Royster, Jr., Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 18 days.

(21) Appl. No.: 10/027,285

(22) Filed: Dec. 21, 2001

(51) Int. Cl.[7] ..... G03C 1/005; G03C 1/494

(52) U.S. Cl. ..... 430/567; 430/569; 430/570; 430/599; 430/603

(58) Field of Search ..... 430/567, 569, 430/570, 599, 603

(56) References Cited

U.S. PATENT DOCUMENTS

| | | | | |
|---|---|---|---|---|
| 4,435,501 | A | 3/1984 | Maskasky | |
| 5,011,767 | A | 4/1991 | Yamashita et al. | |
| 5,244,781 | A | 9/1993 | Takada | |
| 5,250,403 | A | 10/1993 | Antoniades et al. | |
| 5,368,999 | A | * 11/1994 | Makino | 430/603 |
| 5,576,168 | A | 11/1996 | Daubendick et al. | |
| 5,650,266 | A | * 7/1997 | Taguchi et al. | 430/567 |
| 5,922,525 | A | 7/1999 | Garnsey et al. | |
| 5,962,206 | A | 10/1999 | Hall | |
| 6,080,537 | A | * 6/2000 | Sugimoto et al. | 430/567 |

FOREIGN PATENT DOCUMENTS

| | | |
|---|---|---|
| EP | 434 012 | 6/1991 |
| EP | 709 726 | 5/1996 |
| EP | 718 680 | 6/1996 |

* cited by examiner

*Primary Examiner*—Geraldine Letscher
(74) *Attorney, Agent, or Firm*—Andrew J. Anderson

(57) ABSTRACT

A process of sensitizing a tabular grain emulsion containing the steps of (i) providing a tabular grain host emulsion comprised of a dispersing medium and silver halide grains including tabular grains having {111} major faces and an aspect ratio of at least 2, which contain greater than 50 mole percent bromide, based on silver, and which account for greater than 50 percent of total grain projected area;

(ii) adding a thiosulfonate compound of the following Formula I at the surface of the tabular grains of the host emulsion:

$$Z^1SO_2SZ^2 \quad \text{(I)}$$

where $Z^1$ represents is a substituted or unsubsituted aliphatic, aromatic, or heterocyclic group, and $Z^2$ represents a substituted or unsubsituted aliphatic, aromatic, or heterocyclic group, or a monovalent metal or organic cation, where $Z^1$ and $Z^2$ may combine together to form a ring structure or either of $Z^1$ or $Z^2$ may comprise a polymeric backbone wherein the thiosulfonate group may be repeated; and (iii) adding silver and halide ions, where the halide ions include at least, chloride ions, to the tabular grain host emulsion in an amount of from 0.5–7 mole percent based on total silver of the tabular grain host emulsion to precipitate silver halide protrusions forming epitaxial junctions with up to 50 percent of the surface area of the tabular grains essentially at only the corners of the tabular grains, the protrusions having an isomorphic face centered cubic crystal structure and including at least a 10 mole percent higher chloride ion concentration than the host tabular grains.

24 Claims, No Drawings

TABULAR GRAIN SILVER HALIDE EMULSION WITH UNIFORM EPITAXIAL DEPOSITION

FIELD OF THE INVENTION

This invention relates to silver halide photography. More specifically, the invention relates to an improved method for preparing tabular grain silver halide emulsions with uniform epitaxial depositions, and to photographic elements which contain one or more of such improved emulsions.

BACKGROUND OF THE INVENTION

Kofron et al U.S. Pat. No. 4,439,520 ushered in the current era of high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed.

Maskasky U.S. Pat. No. 4,435,501 discloses that use of a site director, such as iodide ion, an aminoazaindene, or a selected spectral sensitizing dye, adsorbed to the surfaces of host tabular grains is capable of directing silver salt epitaxy to selected sites, typically the edges and/or corners, of the host grains. Depending upon the composition and site of the silver salt epitaxy, significant increases in speed may be observed. The most highly controlled site depositions (e.g., corner specific epitaxy siting) and the highest reported photographic speeds reported by U.S. Pat. No. 4,435,501 were obtained by epitaxially depositing silver chloride onto silver iodobromide tabular grains. U.S. Pat. No. 4,435,501 recognized that even when chloride is the sole halide run into a tabular grain emulsion during epitaxial deposition, a minor portion of the halide contained in the host tabular grains can migrate to the silver chloride epitaxy. U.S. Pat. No. 4,435,501 offers as an example the inclusion of minor amounts of bromide ion when silver and chloride ions are being run into a tabular grain emulsion during epitaxial deposition.

In Daubendiek et al. U.S. Pat. No. 5,576,168, sensitized silver iodobromide ultrathin emulsions are disclosed, wherein during sensitization silver and halide ions including iodide and chloride ions are added to ultrathin tabular host grains to deposit epitaxially on up to 50 percent of the surface area of the tabular grains silver halide protrusions containing at least a 10 mole percent higher chloride concentration than the tabular grains and an iodide concentration that is increased by the iodide ion addition. The resulting epitaxially sensitized ultrathin tabular grain emulsions are observed to provide increased speed and contrast as well as improvements in speed-granularity relationships.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the ultrathin tabular grains is more efficient than that overlying all or most of the major faces, still better is epitaxy that is substantially confined to the edges of the host tabular grains, with limited coverage of their major faces, and still more efficient is epitaxy that is confined at or near the corners or other discrete sites of the tabular grains. The spacing of the corners of the major faces of the host tabular grains may in itself reduce photoelectron competition sufficiently to allow near maximum sensitivities to be realized. U.S. Pat. No. 4,435,501 teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain. It has been observed, however, that attemps to limit the number of epitaxial deposit sites often leads to grain to grain inconsistencies, which can lead to less than desired photographic performance.

While various techniques for directing epitaxial depositions on tabular host grains have been previously described, it would be desirable to provide further improved processes for uniformly siting epitaxial depositions on the corners of host tabular grains, particularly in the case where the epitaxial depositions comprise a relatively low molar percent based on the total silver of the host grains (e.g., from 0.5 to 7 mole percent). At such low epitaxial deposition range, it has been observed that most grains do not have epitaxial depositions on the majority of their grain corners, and the number of corners on which epitaxial deposition does occur frequently varies from grain to grain.

It is also known in the art that when fog is generated in the precipitation stage, certain compounds which act as oxidizing agents for silver can be added during the grain-forming process to reduce the undesirable minute silver clusters that constitute this fog. These agents include hydrogen peroxide, peroxy acid salts, disulfides (U.S. Pat. No. 3,397,986), mercury compounds (U.S. Pat. No. 2,728,664), iodine (EP 576,920), iodide releasing agents (EP 563,708, EP 562,476, EP 561,415, and JP06,011,784) and p-quinone (U.S. Pat. No. 3,957,490). The use of thiosulfonate compounds for controlling fog during precipitation has been claimed in the following U.S. patents: U.S. Pat. No. 5,061,614, U.S. Pat. No. 5,079,138; U.S. Pat. No. 5,244,781; U.S. Pat. No. 5,185,241; and U.S. Pat. No. 5,229,263. Likewise, in the following European applications, EP 368,304; EP 435,355; and EP 435,270, the use of thiosulfonates during grain formation of AgX emulsions is claimed.

U.S. Pat. No. 5,244,781 discloses the preparation of silver halide emulsions having at least one structure resulting from differences in halogen compositions, where such emulsions are prepared in the presence of an oxidizing agent for silver. Described grains structures having differences in halogen compositions include layered structures (core-shell) as well as grains having epitaxial depositions. The oxidizing agents are described as compounds which can act on metal silver and convert it into silver ions or react with reducing impurities capable of producing fog centers. Various oxidizing agents are proposed, including thiosulfonate compounds, but there is no teaching as to the impact of any of such oxidizing agents on the directing of uniform epitaxial depositions on host tabular grains.

It would be desirable to provide a process for epitaxially sensitization of tabular grain emulsions with relatively low molar levels of epitaxy depositions, wherein the depositions are more uniformly deposited on the majority of corners of the host tabular grains.

SUMMARY OF THE INVENTION

In one aspect this invention is directed towards a process of sensitizing a tabular grain emulsion containing the steps of (i) providing a tabular grain host emulsion comprised of a dispersing medium and silver halide grains including tabular grains having {111} major faces and an aspect ratio of at least 2, which contain greater than 50 mole percent bromide, based on silver, and which account for greater than 50 percent of total grain projected area;

(ii) adding a thiosulfonate compound of the following Formula I at the surface of the tabular grains of the host emulsion:

$$Z^1SO_2SZ^2 \quad (I)$$

where $Z^1$ represents is a substituted or unsubsituted aliphatic, aromatic, or heterocyclic group, and $Z^2$ represents a substituted or unsubsituted aliphatic, aromatic, or heterocyclic group, or a monovalent metal or organic cation, where $Z^1$ and $Z^2$ may combine together to form a ring structure or either of $Z^1$ or $Z^2$ may comprise a polymeric backbone wherein the thiosulfonate group may be repeated, and (iii) adding silver and halide ions, where the halide ions include at least chloride ions, to the tabular grain host emulsion in an amount of from 0.5–7 mole percent based on total silver of the tabular grain host emulsion to precipitate silver halide protrusions forming epitaxial junctions with up to 50 percent of the surface area of the tabular grains essentially at only the corners of the tabular grains, the protrusions having an isomorphic face centered cubic crystal structure and including at least a 10 mole percent higher chloride ion concentration than the host tabular grains.

In another aspect, this invention is directed towards an improved radiation-sensitive emulsion comprised of (i) a dispersing medium (ii) silver halide grains including host tabular grains having {111} major faces and an aspect ratio of at least 2, which contain greater than 50 mole percent bromide, based on silver, and which account for greater than 50 percent of total grain projected area, (iii) a thiosulfonate compound of the following formula (I):

$$Z^1SO_2SZ^2 \quad (I)$$

where $Z^1$ represents is a substituted or unsubsituted aliphatic, aromatic, or heterocyclic group, and $Z^2$ represents a substituted or unsubsituted aliphatic, aromatic, or heterocyclic group, or a monovalent metal or organic cation, where $Z^1$ and $Z^2$ may combine together to form a ring structure or either of $Z^1$ or $Z^2$ may comprise a polymeric backbone wherein the thiosulfonate group may be repeated;

(iv) a spectral sensitizing dye adsorbed to the surfaces of the tabular grains, and (v) latent image forming chemical sensitization sites on the surfaces of the tabular grains comprising epitaxially deposited silver halide protrusions exhibiting an isomorphic face centered cubic crystal lattice structure and containing a silver chloride concentration at least 10 mole percent higher than that of the tabular grains, wherein the epitaxial protrusions comprise from 0.5–7 mole percent based on total silver of the host tabular grains and form epitaxial junctions with up to 50 percent of the surface area of the tabular grains and at the majority of corners of the tabular grains.

In a further aspect, this invention is directed towards a photographic element comprised of a support, and a silver halide emulsion layer coated on the support comprised of an emulsion as described herein.

In preferred embodiments of the invention, the epitaxially deposited silver halide protrusions of the tabular grain emulsion comprise from 1–6 mole percent, more preferably 3–6 mole percent, based on total silver of the host tabular grains.

The results of the invention employing specific epitaxial sensitization deposits are an improvement over the position demonstrated by the use of epitaxially sensitized tabular grain emulsions outside the invention.

DETAILED DESCRIPTION OF THE INVENTION

The invention is directed to an improvement in epitaxially sensitized tabular grain photographic emulsions. The emulsions are specifically contemplated for incorporation in camera speed color photographic films.

As used herein, the term "tabular" grain refers to silver halide grains having an aspect ratio of at least 2, where aspect ratio is defined as the equivalent circular diameter (ECD) of the major face of the grain divided by the grain thickness. Tabular grain emulsions with mean tabular grain thicknesses of less than about 0.07 $\mu$m are herein referred to as "ultrathin" tabular grain emulsions. Tabular grain emulsions used in accordance with the invention preferably have an average tabularity (T) of greater than 25 (more preferably greater than 100), where the term "tabularity" is employed in its art recognized usage as $T=ECD/t^2$ where ECD is the average equivalent circular diameter of the tabular grains in micrometers and t is the average thickness in micrometers of the tabular grains. Tabularity increases markedly with reductions in tabular grain thickness. Preferably, any non-ultrathin tabular grain emulsions used in accordance with the invention have an average thickness of less than 0.3 micrometers for green or red sensitized emulsions, and 0.5 micrometers for blue sensitive emulsions.

Concerning tabular grains in general, to maximize the advantages of high tabularity it is generally preferred that tabular grains satisfying the stated criteria account for the highest conveniently attainable percentage of the total grain projected area of an emulsion, with at least 50% total grain projected area (% TGPA) being typical. For example, in preferred emulsions, tabular grains satisfying the stated criteria above account for at least 70 percent of the total grain projected area. In the highest performance tabular grain emulsions, tabular grains satisfying the criteria above account for at least 90 percent of total grain projected area.

The emulsions of the invention can be realized by chemically and spectrally sensitizing any conventional tabular grain emulsion in which the tabular grains have {111} major faces; contain greater than 50 mole percent bromide; and account for greater than 50 percent of total grain projected area. Preferably, such grains exhibit an average ECD of at least 0.7 $\mu$m, and an average thickness of less than 0.3 $\mu$m.

Such high bromide tabular grain emulsions which may be used as host grains can be selected, e.g., from among a variety of conventional teachings. The high bromide tabular grain emulsions preferably contain greater than 70 mole percent, and optimally at least 90 mole percent bromide, based on total silver. Unless otherwise stated, references to the composition of the tabular grains exclude the silver halide epitaxy. In one form the high bromide tabular grains can be silver bromide grains. It is also possible to include minor amounts of chloride ion in the host tabular grains. Silver chloride, like silver bromide, forms a face centered cubic crystal lattice structure. Therefore, all of the halide not accounted for by bromide can be chloride, if desired. Chloride preferably accounts for no more than 20 mole percent, most preferably no more than 15 mole percent of total silver. Iodide can be present in concentrations ranging up to its saturation limit, but is usually limited to 20 mole percent or less, preferably 12 mole percent or less. These ultrathin tabular grains thus may include silver iodobromide, silver iodochlorobromide and silver chloroiodobromide grains, where the halides are named in their order of ascending concentration. Silver iodobromide grains represent a preferred form of high bromide tabular grains. For camera speed films it is generally preferred that the tabular grains contain at least 0.25 (more preferably at least 0.5 and most preferably at least 1.0) mole percent iodide, based on silver, most preferably in the range of from about 1 to 12 mole percent iodide.

Representative high bromide tabular grain emulsions which may be used as host tabular grains include those described in the following references: Research Disclosure, Item 22534, January 1983, published by Kenneth Mason Publications, Ltd., Emsworth, Hampshire P010 7DD, England; Daubendiek et al U.S. Pat. No. 4,414,310; Solberg et al U.S. Pat. No. 4,433,048; Wilgus et al U.S. Pat. No. 4,434,226; Maskasky U.S. Pat. No. 4,435,501; Kofron et al U.S. Pat. No. 4,439,520; Yamada et al U.S. Pat. No. 4,647,528; Sugimoto et al U.S. Pat. No. 4,665,012; Daubendiek et al U.S. Pat. No. 4,672,027; Yamada et al U.S. Pat. No. 4,679,745; Daubendiek et al U.S. Pat. No. 4,693,964, Maskasky U.S. Pat. No. 4,713,320; Nottorf U.S. Pat. No. 4,722,886; Sugimoto U.S. Pat. No. 4,755,456; Goda U.S. Pat. No. 4,775,617; Ellis U.S. Pat. No. 4,801,522; Ikedaetal U.S. Pat. No. 4,806,461, Ohashi et al U.S. Pat. No. 4,835,095; Makino et al U.S. Pat. No. 4,835,322; Daubendiek et al U.S. Pat. No. 4,914,014; Aida et al U.S. Pat. No. 4,962,015; Ikeda et al U.S. Pat. No. 4,985,350, Piggin et al U.S. Pat. No. 5,061,609; Piggin et al U.S. Pat. No. 5,061,616, Tsaur et al U.S. Pat. No. 5,210,013; Black et al U.S. Pat. No. 5,219,720; Kim et al U.S. Pat. No. 5,236,817; Brust U.S. Pat. No. 5,248,587; Tsaur et al U.S. Pat. No. 5,252,453, Kim et al U.S. Pat. No. 5,272,048; Delton U.S. Pat. No. 5,310,644; Black et al U.S. Pat. No. 5,334,495, Chaffee et al U.S. Pat. No. 5,358,840; Delton U.S. Pat. No. 5,372,927; Cohen et al U.S. Pat. No. 5,391,468; Maskasky U.S. Pat. No. 5,411,851; Maskasky U.S. Pat. No. 5,411,853; Maskasky U.S. Pat. No. 5,418,125; Delton U.S. Pat. No. 5,460,934; Wen U.S. Pat. No. 5,470,698.

In a preferred form of the invention, the host tabular grains comprise ultrathin tabular grains, and in particular ultrathin tabular grain emulsions in which the tabular grains have {111} major faces; contain greater than 70 mole percent bromide and at least 0.25 mole percent iodide, based on silver, account for greater than 90 percent of total grain projected area; exhibit an average ECD of at least 0.7 $\mu$m; and exhibit an average thickness of less than about 0.07 $\mu$m. Although these criteria are too stringent to be satisfied by the vast majority of known tabular grain emulsions, a few published precipitation techniques are capable of producing emulsions satisfying these criteria. U.S. Pat. No. 5,250,403, here incorporated by reference, demonstrates preferred silver iodobromide emulsions satisfying these criteria. Zola and Bryant EP 0 362 699 also discloses silver iodobromide emulsions satisfying these criteria. Daubendiek et al. U.S. Pat. No. 5,576,168 discloses further preferred procedures for preparation of ultrathin tabular grains, the disclosures of which are incorporated by reference herein.

As disclosed by Delton U.S. Pat. No. 5,372,972, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (° C.) boundaries of Curve A (preferably within the boundaries of Curve B) shown by Delton, corresponding to Curves A and B of Piggin et al U.S. Pat. Nos. 5,061,609 and 5,061,616. Under these conditions of precipitation the presence of chloride ion actually contributes to reducing the thickness of the tabular grains. Although it is preferred to employ precipitation conditions under which chloride ion, when present, can contribute to reductions in the tabular grain thickness, it is recognized that chloride ion can be added during any conventional tabular grain precipitation.

Iodide can be uniformly distributed within the host tabular grains. To obtain a further improvement in speed-granularity relationships it is preferred that the iodide distribution satisfy the teachings of Solberg et al U.S. Pat. No. 4,433,048. Iodide in the host tabular grains is most preferably present in the regions of the grains that are to form epitaxial junctions with the silver halide epitaxy, and it is thus contemplated to nucleate and grow the host tabular grains as silver bromide tabular grains until late in the precipitation process. This allows the overall concentrations of iodide in the host tabular grains to be maintained at low levels while satisfying the preferred iodide concentrations in the area receiving silver halide epitaxy. Silver iodobromide grain precipitation techniques, including those of U.S. Pat. No. 5,250,403 and EP 0 362 699, can be modified to silver bromide tabular grain nucleation and growth simply by omitting iodide addition, thereby allowing iodide incorporation to be delayed until late in the precipitation. U.S. Pat. No. 4,439,520 teaches that tabular grain silver iodobromide and bromide precipitations can differ solely by omitting iodide addition for the latter.

The tabular grains produced by the teachings of U.S. Pat. No. 5,250,403, EP 0 362 699 and U.S. Pat. No. 5,372,972 all have {111} major faces. Such tabular grains typically have triangular or hexagonal major faces. The tabular structure of the grains is attributed to the inclusion of parallel twin planes.

The ultrathin tabular grain emulsions employed as the host emulsion grains in preferred embodiments of the invention comprise ultrathin tabular grains which account for greater than 90 percent of total grain projected area of the emulsion. Ultrathin tabular grain emulsions in which the tabular grains account for greater than 97 percent of total grain projected area can be produced by the preparation procedures taught by U.S. Pat. No. 5,250,403 and are especially preferred. U.S. Pat. No. 5,250,403 reports emulsions in which >99% (substantially all) of total grain projected area is accounted for by tabular grains. Similarly, U.S. Pat. No. 5,372,972 reports that substantially all of the grains precipitated in forming the tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 50 percent of total grain projected area of the tabular host grain emulsion preferably exhibit an average ECD of at least 0.7 μm. The advantage to be realized by maintaining the average ECD of at least 0.7 μm is demonstrated in Tables III and IV of U.S. Pat. No. 5,250,403. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the tabular grain emulsions employed in preferred embodiments of the invention the tabular grains accounting for greater than 90 percent of total grain projected area exhibit a mean thickness of less than about 0.07 μm. At a mean grain thickness of 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by U.S. Pat. No. 5,250,403 these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of U.S. Pat. No. 5,250,403, U.S. Pat. No. 4,439,520 suggests a practical minimum tabular grain thickness of about 0.01 μm.

Preferred tabular grain emulsions are those in which grain to grain variance is held to low levels. U.S. Pat. No. 5,250,403 reports tabular grain emulsions in which greater than 90 percent of the tabular grains have hexagonal major faces. U.S. Pat. No. 5,250,403 also reports tabular grain emulsions exhibiting a coefficient of variation (COV) based on ECD of less than 25 percent and even less than 20 percent. Disproportionate size range reductions in the size-frequency distributions of tabular grains having greater than mean ECD's (hereinafter referred to as the $>ECD_{av.}$ grains) can be realized by modifying the procedure for precipitation of the tabular grain emulsions in the following manner: Tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent. Any of the conventional techniques for oxidizing the methionine of a gelatino-peptizer can be employed, such as discussed in U.S. Pat. 5,576,168.

In the practice of the present invention tabular grains receive during chemical sensitization a relatively small molar amount (i.e., from 0.5 to 7 mole percent, based on total silver, where total silver includes that in the host and epitaxy) of epitaxially deposited silver halide forming protrusions at selected sites on the tabular grain surfaces. Subject to the addition of a thiosulfonate compound as specifically described herein prior to epitaxial deposition, preferred techniques for chemical and spectral sensitization of the tabular grain emulsions of the invention are those such as described by U.S. Pat. Nos. 4,435,501 and 5,576,168 cited above and here incorporated by reference, which disclose improvements in sensitization by epitaxially depositing silver halide at selected sites on the surfaces of the host tabular grains. In preferred embodiments of the invention, the epitaxially deposited silver halide protrusions of the tabular grain emulsion comprise from 1–6 mole percent, more preferably 3–6 mole percent, based on total silver of the host tabular grains.

Speed increases observed in epitaxially sensitized tabular grain emulsions are attributed to restricting silver halide epitaxy deposition to a small fraction of the host tabular grain surface area, and further improvements are obtained when such depositions are uniformly distributed among the corners of the host emulsion grains. Silver halide epitaxy in the emulsions of the invention is restricted to less than 50 percent of the tabular grain surface area and, preferably, to a much smaller percent of the tabular grain surface area. Specifically, silver halide epitaxy may be restricted to less than 25 percent, preferably less than 10 percent, and optimally less than 5 percent of the host grain surface area.

U.S. Pat. No. 4,435,501 teaches various techniques for restricting the surface area coverage of the host tabular grains by silver halide epitaxy that can be applied in forming the emulsions of this invention. U.S. Pat. No. 4,435,501 teaches employing spectral sensitizing dyes that are in their aggregated form of adsorption to the tabular grain surfaces capable of directing silver halide epitaxy to the edges or corners of the tabular grains. Cyanine dyes that are adsorbed to host ultrathin tabular grain surfaces in their J-aggregated form constitute a specifically preferred class of site directors. U.S. Pat. No. 4,435,501 also teaches to employ non-dye adsorbed site directors, such as aminoazaindenes (e.g., adenine) to direct epitaxy to the edges or corners of the tabular grains. In still another form U.S. Pat. No. 4,435,501 relies on overall iodide levels within the host tabular grains of at least 8 mole percent to direct epitaxy to the edges or corners of the tabular grains. In yet another form U.S. Pat. No. 4,435,501 adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even if it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

As the thiosulfonate compounds of Formula I employed in accordance with the invention are believed to facilitate initiation of nucleation of the epitaxial depositions at the corners of the host tabular grains rather than prohibit deposition at other sites, they may be added either prior to or after addition of any such desired site directors.

U.S. Pat. No. 4,435,501 observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host tabular grains. It would be more precise to reference the higher chloride concentration in the silver halide protrusions to the chloride ion concentration in the epitaxial junction forming portions of the ultrathin tabular grains, but this is not necessary, since the chloride ion concentrations of the ultrathin tabular grains are contemplated to be substantially uniform (i.e., to be at an average level) or to decline slightly at the host gain surface relative to the total host grain chloride concentrations due to iodide displacement in the epitaxial junction regions.

Contrary to the teachings of U.S. Pat. No. 4,435,501, it was found in U.S. Pat. No. 5,576,168 that improvements in photographic speed and contrast can be realized by adding iodide ions along with silver and chloride ions to the tabular grain emulsions while performing epitaxial deposition. This results in increasing the concentration of iodide in the epitaxial protrusions above the low (substantially less than 1 mole percent) levels of iodide that migrate from the host iodobromide host tabular grains during silver and chloride ion addition. Although any increase in the iodide concentration of the face centered cubic crystal lattice structure of the epitaxial protrusions improves photographic performance, it is preferred to increase the iodide concentration to a level of at least 1.0 mole percent, preferably at least 1.5 mole percent, based on the silver in the silver halide protrusions.

Since iodide ions are much larger than chloride ions, it is recognized in the art that iodide ions can only be incorporated into the face centered cubic crystal lattice structures formed by silver chloride and/or bromide to a limited extent. This is discussed, for example, in Maskasky U.S. Pat. Nos. 5,238,804 and 5,288,603. Further increases in speed and contrast can be realized by introducing bromide ions along with silver, chloride, and iodide ions during epitaxial deposition. Analysis indicates that the introduction of chloride and bromide ions together during precipitation of the epitaxial protrusions facilitates higher iodide incorporations. This can be explained in terms of the increased crystal cell lattice dimensions imparted by the increased levels of bromide ions.

Due to the different solubilities of different silver halides and migration of halide ions from the host tabular grain, the actual halide concentrations of the epitaxial deposits is highly dependent upon the relative amount of epitaxy deposited as well as the nominal (input) halide percentages added during epitaxial deposition, and the resulting actual halide concentrations can vary significantly from the nominal halide percentages added. Analytical electron microscopy (AEM) techniques may be employed to determine the actual as opposed to nominal (input) compositions of the silver halide epitaxial protrusions. The general procedure for AEM is described by J. I. Goldstein and D. B. Williams, "X-ray Analysis in the TEM/STEM", *Scanning Electron Microscopy*/1977; Vol. 1, IIT Research Institute, March 1977, p. 651. The composition of an individual epitaxial protrusion may be determined by focusing an electron beam to a size small enough to irradiate only the protrusion being examined. The selective location of the epitaxial protrusions at the corners of the host tabular grains can facilitate addressing only the epitaxial protrusions.

Changes in the actual epitaxial composition which may result from changing the percent of epitaxy while maintaining the same nominal compositions can be understood by considering the source of bromide incorporated into the epitaxy. Excess free bromide inherent in silver iodobromide emulsions provides a significant source of bromide for epitaxial growth. As the mole percentage of added primarily chloride epitaxy decreases without changing the ratio of added halides, the percentage of bromide incorporated into the epitaxy will increase (since the total contribution from the emulsion will be relatively constant) while the percentage of chloride decreases. An increase in the actual percentage of bromide may also result in a larger lattice, and increase the efficiency of iodide incorporation. Having a high level of host grain surface iodide may also promote higher incorporation of iodide during the epitaxial deposition step.

As disclosed in concurrently filed, copending, commonly assigned U.S. Ser. No. 10/027300, the disclosure of which is incorporated herein by reference, the highest levels of retained photographic speed advantage attributable to the use of an epitaxially sensitized ultrathin grain emulsion in a multilayer element comprising both an ultrathin tabular grain emulsion and a thicker tabular grain emulsion is realized when the silver halide epitaxy deposited on the ultrathin grain emulsion contains both (1) an actual chloride concentration of from 20–50 mole %, based on epitaxially deposited silver, the chloride concentration being at least 10 mole percent higher than that of the tabular grains, and (2) an actual iodide concentration of from 1 to 7 mole %, based on epitaxially deposited silver, in the face centered cubic crystal lattice structure of the protrusions. In order to obtain such actual epitaxial deposition halide concentrations, it is generally preferable to use relatively high nominal levels of chloride ions added during epitaxial deposition, or to limit the percentage of host grain surface iodide. Such procedures are especially important when using relatively low levels of epitaxy (e.g., where the epitaxially deposited silver halide protrusions of the ultrathin tabular grain emulsion comprise from 0.5–7 mole percent, more preferably 1–6 mole percent, and most preferably 3–6 mole percent, based on total silver of the host tabular grains).

In accordance with the invention, a thiosulfonate compound of Formula I is added at the surface of the tabular grains of the host emulsion prior to precipitation of epitaxial depositions at the corners of the host emulsion tabular grains.

$$Z^1SO_2SZ^2 \quad \text{(I)}$$

$Z^1$ represents a substituted or unsubsituted aliphatic, aromatic, or heterocyclic group, and $Z^2$ represents a substituted or unsubsituted aliphatic, aromatic, or heterocyclic group, or a monovalent metal or organic cation, where $Z^1$ and $Z^2$ may combine together to form a ring structure or either of $Z^1$ or $Z^2$ may comprise a polymeric backbone wherein the thiosulfonate group may be repeated. Representative $Z^1$ groups include substituted or unsubstituted alkyl, aryl, heteroaryl, and arylalkyl groups, with aryl groups being preferred. Representative $Z^2$ groups include those as in $Z^1$, and any of the monovalent metal ions such as sodium or potassium or lithium ion, or an organic cation such as organic ammonium ion (e.g., tetramethylammonium, and tetrabutylammonium), organic phosphonium ion (e.g., tetraphenylphosphonium), and a gaunidil group. In preferred embodiments, $Z^2$ represents a monovalent metal or tetraalkylammonium cation.

When $Z^1$ or $Z^2$ represents an aliphatic group, it may be a saturated or unsaturated, straight-chain, branched or cyclic aliphatic hydrocarbon group and is preferably an alkyl group having 1 to 22 carbon atoms or an alkenyl or alkynyl group having 2 to 22 carbon atoms. These groups can be a substituted. Examples of the alkyl group are methyl, ethyl, prophyl, butyl, pentyl, hexyl, octyl, 2-ethylhexyl, decyl, dodecyl, hexadecyl, octadecyl, cyclohexyl, isopropyl, and t-butyl. Examples of the alkenyl group are allyl and butenyl. Examples of the alkynyl group are propargyl and butynyl.

When $Z^1$ or $Z^2$ represents an aromatic group, it may be an aromatic group of monocyclic or condensed-ring, preferably one having 6 to 20 carbon atoms. Examples of the aromatic group are phenyl and naphthyl. These groups may be substituted.

When $Z^1$ or $Z^2$ represents a heterocyclic group, it may be a 3- to 15-membered ring, preferably 3- to 6-membered ring, having at least one element selected from nitrogen, oxygen, sulfur, selenium, and tellurium and at least one carbon. Examples of heterocyclic groups include a pyrrolidine ring a piperidine ring, a pyridine ring, a tetrahydrofurane ring, a thiophene ring, a oxazole ring, a thiazole ring, a imidazole ring, a benzothiazole ring, a benzoxazole ring, a henzimidazole ring, a selenazole ring, a benzoselenazole ring, a tellurazole ring, a triazole ring, a benzotriazole ring, a terazole ring, a oxadiazole ring, and a thiadiazole ring.

Examples of possible substituents on $Z^1$ or $Z^2$ groups include alkyl (e.g., methyl, ethyl, and hexyl), alkoxy (e.g., methoxy, ethoxy, and octyloxy), aryl (e.g., phenyl, naphthyl, and tolyl), hydroxyl, halogen (e.g., fluorine, chlorine, bromine, and iodine), aryloxy (e.g., phenoxy), alkylthio (e.g., methylthio and butylthio), arylthio (e.g., phenylthio), acyl (e.g., acetyl, propionyl, butyryl, and valeryl), sulfonyl (e.g., methyl sulfonyl and phenylsulfonyl), acrylamino (e.g., acetylamino and benzoylamino), sulfonylamino (e.g., methanesulfonylamino and benzenesulfonylamino), acyloxy (e.g., acetoxy and benzoxy), carboxyl, cyano, sulfo, amino, and additional —$SO_2SZ^3$ groups, where $Z^3$ is as defined for $Z^2$).

Preparations of compounds of formula (I) have been described in the chemical literature such as in Chem. Lett. 1987, 11, 2161; Organic Syntheses Collective Volume VI, 1988, p 1016, Organic Syntheses, 1974, 54, 33; *J. Org. Chem.* 1986, 51(26), 5235, Biochem. Prep. 1963, 10, 72, Journal of Organic Chemistry, Vol. 53, p. 396, 1988; JP-A-54-1019; and British Patent 972,211, or they may also be commercially available. In a preferred embodiment of the invention, the compound of Formula I is a toluene thiosulfonate compound. Representative examples of compounds of Formula I include the following:

I-1 $CH_3SO_2SNa$

I-2 $C_2H_5SO_2SNa$

I-3 $C_3H_7SO_2SK$

I-4 $C_4H_9SO_2SLi$

-continued

I-5 $C_6H_{13}SO_2SNa$

I-6 $C_8H_{17}SO_2SNa$

I-7 $CH_3(CH_2)_3CH(C_2H_5)CH_2SO_2S.NH_4$

I-8 $C_{10}H_{21}SO_2SNa$

I-9 $C_{12}H_{25}SO_2SNa$

I-10 $C_{16}H_{33}SO_2SNa$

I-11 $(CH_3)_2CH—SO_2SK$

I-12 $t\text{-}C_4H_9SO_2S.Na$

I-13 $CH_3OCH_2CH_2SO_2.Na$

I-14 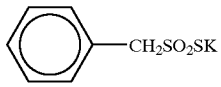

I-15 $CH_2{=}CHCH_2SO_2SNa$

I-16 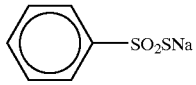

I-17 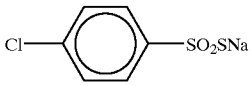

I-18 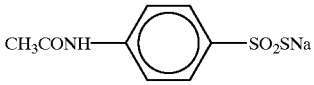

I-19 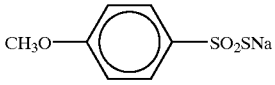

I-20 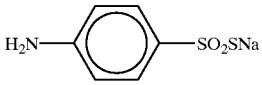

I-21 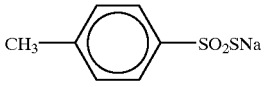

I-22 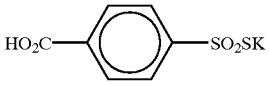

I-23 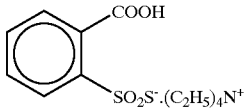

I-24 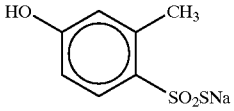

-continued
I-25
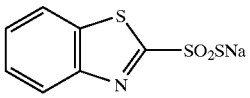
I-26
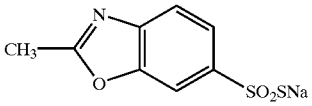
I-27
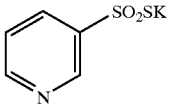
I-28
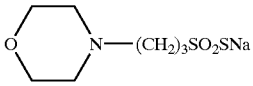
I-29
$KSSO_2(CH_2)_2SO_2SK$
I-30
$NaSSO_2(CH_2)_4SO_2SNa$
I-31
$NaSSO_2(CH_2)_4S(CH_2)_4SO_2SNa$
I-32
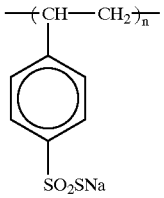
I-33
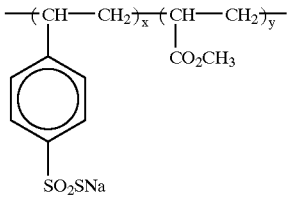
x:y = 1/1
(mol ratio)
I-34
$C_2H_5SO_2S—CH_3$
I-35
$C_8H_{17}SO_2SCH_2CH_3$
I-36
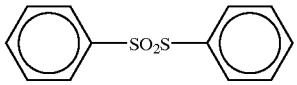
I-37
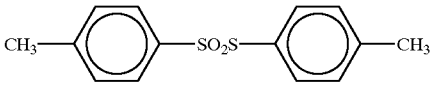
I-38
$C_2H_5SO_2SCH_2CH_2CN$
I-39
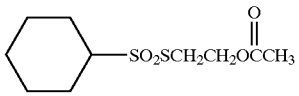
I-40
$C_4H_9SO_2SCH(CH_3)CH_2CN$
-continued
I-41
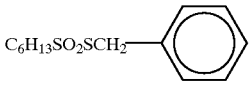
I-42
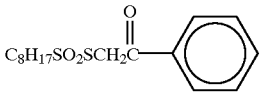
I-43
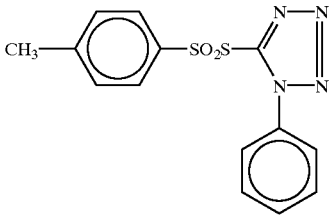
I-44
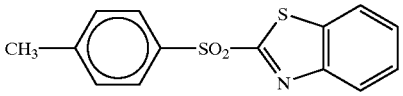
I-45
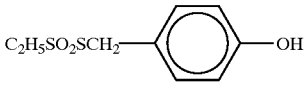
I-46
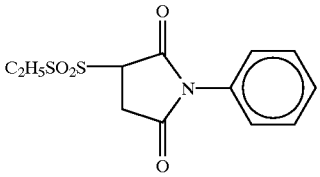
I-47
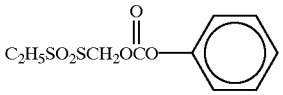
I-48
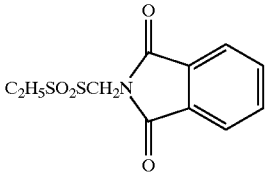
I-49
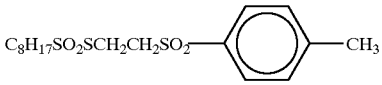
I-50
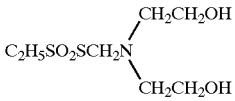
I-51
$C_2H_5SO_2SCH_2CH_2CH_2CH_2OH$
I-52
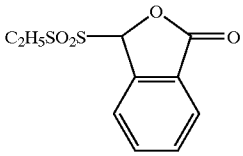

-continued

I-53

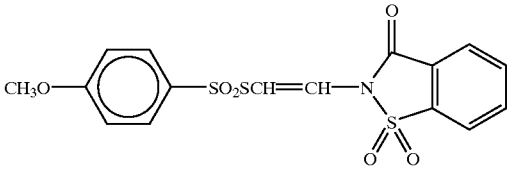

I-54 $CH_3SSO_2(CH_2)_4SO_2SCH_3$

I-55 $CH_3SSO_2(CH_2)_2SO_2SCH_3$

I-56

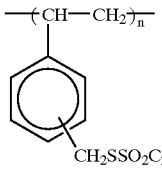

I-57

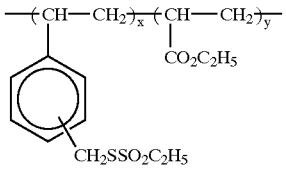

x:y = 2/1
(mol ratio)

I-58

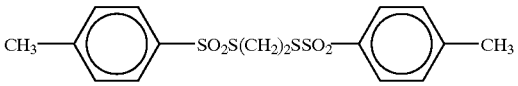

I-59 $C_2H_5SO_2SCH_2CH_2SO_2CH_2CH_2CH_2SSO_2C_2H_5$

I-60

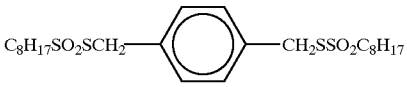

I-61

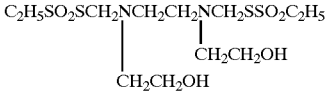

I-62

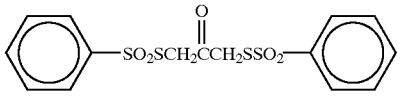

I-63

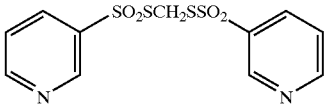

I-64 $C_2H_5SO_2SSSO_2C_2H_5$

I-65 $(n)C_3H_7SO_2SSSO_2C_3H_7(n)$

I-66

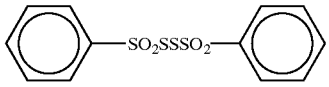

To prevent desensitization of the emulsion, it is preferred that the compound of Formula I be added to the host emulsion in an amount of not more than that which is required to facilitate epitaxial deposition at the majority of host emulsion tabular grain corners. Preferred amounts are not more than about 10,000 $\mu$mol per mole of silver in the host grain emulsion, more preferably from about 1 to 1000 $\mu$mol per mol of silver, and most preferably from about 10 to 500 $\mu$mol per mol of silver. Such relatively small amounts of thiosulfonate compound has been found effective to help initiate nucleation of the epitaxial deposits uniformly at a majority of the corners of the grains of the host emulsion.

Silver halide epitaxy can by itself increase photographic speeds to levels comparable to those produced by substantially optimum chemical sensitization with sulfur and/or gold. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure* December 1989, Item 308119, Section III. Chemical sensitization. U.S. Pat. No. 4,439,520 illustrates the application of these sensitizations to tabular grain emulsions.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

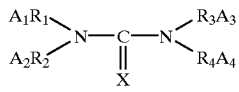

(V)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VI)}$$

wherein

L is a mesoionic compound;

X is an anion; and $L^1$ is a Lewis acid donor.

U.S. Pat. No. 4,439,520 discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. U.S. Pat. No. 4,435,501 teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes is available. The spectral sensitizing dyes disclosed by U.S. Pat. No. 4,439,520, particularly the blue spectral sensitizing dyes shown by structure and their longer methine chain analogous that exhibit absorption maxima in the green and red portions of the spectrum, are particularly preferred for incorporation in the ultrathin tabular grain emulsions of the invention. The selection of J-aggregating blue absorbing spectral sensitizing dyes for use as site directors is specifically contemplated. A general summary of useful spectral sensitizing dyes is provided by *Research Disclosure*, December 1989, Item 308119, Section IV. Spectral sensitization and desensitization, A. Spectral sensitizing dyes.

While in specifically preferred forms of the invention a spectral sensitizing dye can act also as a site director and/or can be present during the finish, the only required function that a spectral sensitizing dye perform is to increase the sensitivity of the emulsion to at least one region of the spectrum. Hence, the spectral sensitizing dye can, if desired, be added to an ultrathin tabular grain according to the invention after chemical sensitization has been completed.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of ultrathin grain emulsions produce very large speed increases. This is in part attributable to relatively lower mean grain volumes and in part to the relatively higher mean grain surface areas available for spectral sensitizing dye adsorption.

Aside from the features of tabular grain emulsions described above, emulsions employed in this invention and their preparation can take any desired conventional form. For example, in accordance with conventional practice, after an emulsion satisfying the requirements of the invention has been prepared, it can be blended with one or more other emulsions. Conventional emulsion blending is illustrated in *Research Disclosure*, Vol. 308, Item 308119, Section I, Paragraph I, the disclosure of which is here incorporated by reference.

The tabular grain emulsions of the invention may be used in any photographic elements, and are preferably used in multicolor elements which contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in the elements of this invention, reference will be made to *Research Disclosure*, September 1994, Item 36544, available as described above, which will be identified hereafter by the term "*Research Disclosure*". Sections hereafter referred to are Sections of the *Research Disclosure*.

Except as provided, elements containing silver halide emulsions in accordance with this invention can be either negative-working or positive-working as indicated by the type of processing instructions (i.e. color negative, reversal, or direct positive processing) provided with the element. Suitable methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Image dye-forming couplers may be included in the element such as couplers that form cyan dyes upon reaction with oxidized color developing agents which are described in such representative patents and publications as: U.S. Pat.

Nos. 2,367,531, 2,423,730, 2,474,293, 2,772,162, 2,895, 826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311, 082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, *Band III*, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298, 443, 2,407,210, 2,875,057, 3,048,194, 3,265,506, 3,447,928, 4,022,620, 4,443,536, and "Farbkuppler-eine Literature Ubersicht," published in Agfa Mitteilungen, *Band III*, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. No. Nos. 1,939,231; 2,181, 944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in elements in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019, 492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. No. Nos. 3,137,578; 3,148,022, 3,148,062; 3,227,554; 3,384, 657; 3,379,529; 3,615,506; 3,617,291; 3,620,746; 3,701, 783; 3,733,201; 4,049,455; 4,095,984; 4,126,459; 4,149, 886; 4,150,228; 4,211,562; 4,248,962; 4,259,437; 4,362, 878; 4,409,323; 4,477,563; 4,782,012; 4,962,018; 4,500, 634; 4,579,816; 4,607,004; 4,618,571; 4,678,739; 4,746, 600; 4,746,601; 4,791,049; 4,857,447; 4,865,959; 4,880, 342; 4,886,736; 4,937,179; 4,946,767; 4,948,716; 4,952, 485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

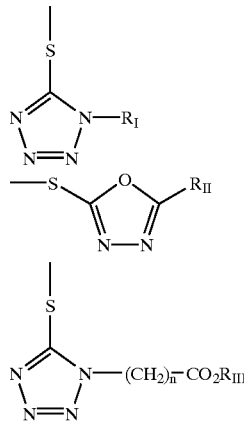

-continued

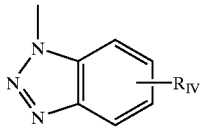

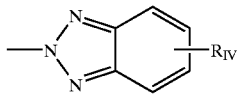

wherein $R_1$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323, 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

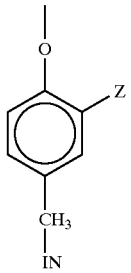

-continued

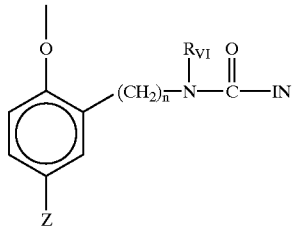

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

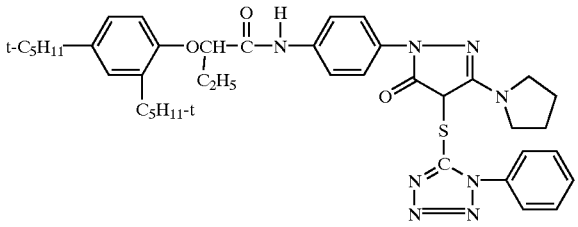

D2

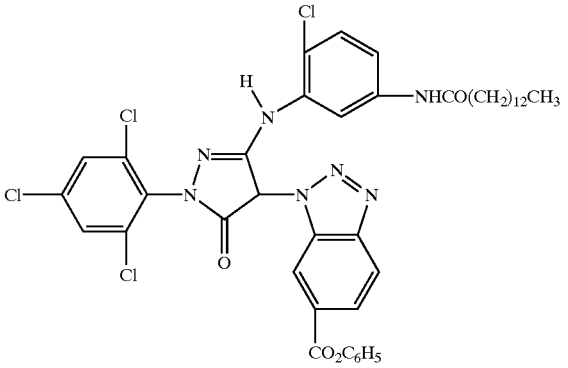

D3

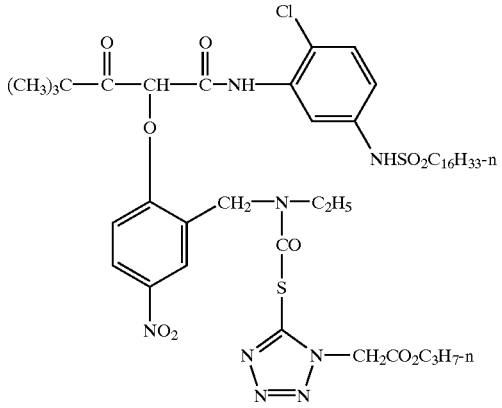

-continued
D4
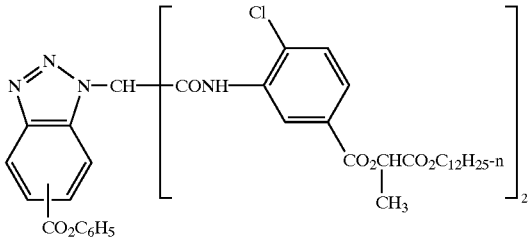
D5
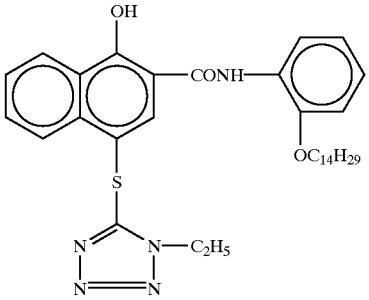
D6
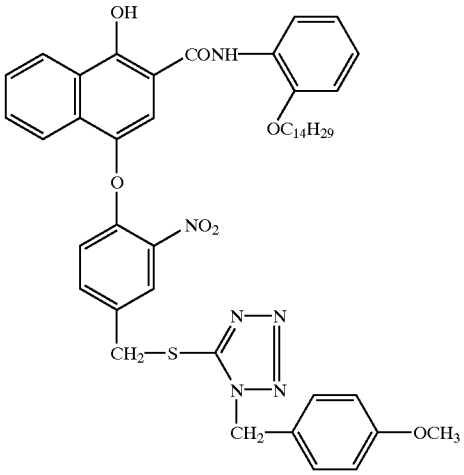
D7
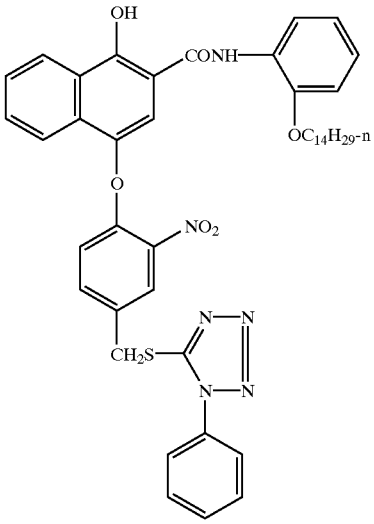
-continued
D8
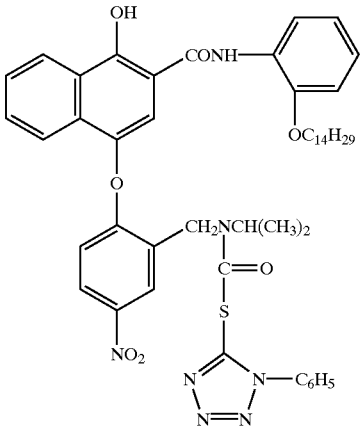
D9
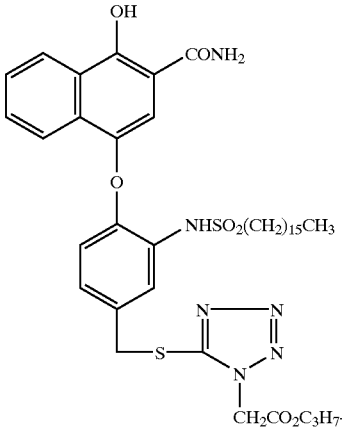
D10
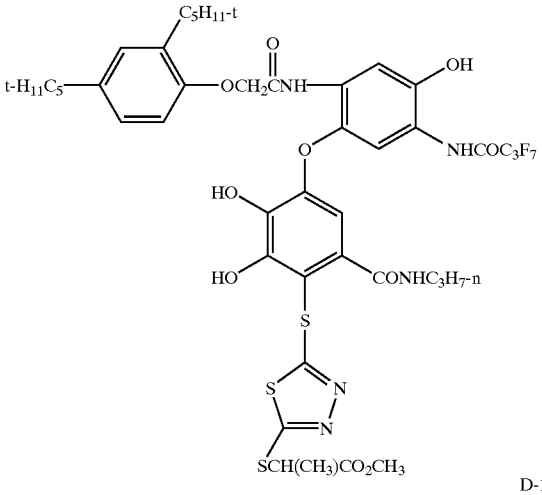
D-11
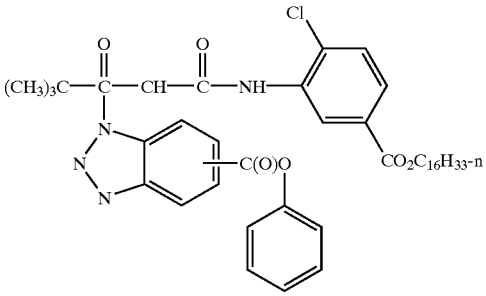

-continued

D-12

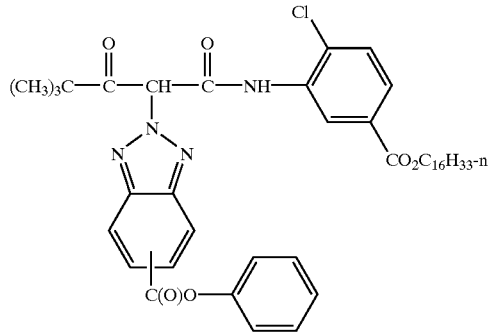

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C41 color process as described in the *British Journal of Photography Annual of* 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as: 4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES

The invention can be better appreciated by reference to following specific examples, wherein epitaxially sensitized emulsions are prepared and coated on photographic film support. Photographic speeds are reported as relative log speeds, where a speed difference of 30 log units equals a speed difference of 0.3 log E, where E represents exposure in lux-seconds. Halide ion concentrations are reported as mole percent (M %), based on silver.

Host Grain Emulsion E-1

A vessel equipped with a stirrer was charged with 89 L of water containing 142 g lime-processed bone gelatin, 179 g ammonium sulfate, 71 g NaBr and an antifoamant. The pH was adjustment to 2.5. Nucleation was accomplished by balanced simultaneous addition of $AgNO_3$ and NaBr solutions both at 2.5 M (1.611 Kg/min $AgNO_3$ for 6 sec and 1.611 Kg/min NaBr for 6 sec). Following nucleation, the reactor gelatin was quickly oxidized by the addition of 4.7 g of Oxone™ (2 $KHSO_5.KHSO_4.K_2SO_4$) in 942 mL of water. The pH was adjusted to 10 followed by the addition of 1 Kg of gelatin with acid to bring the pH to 5.8. After introducing 2.0 moles of NaBr (4.0 M) to the kettle, the growth stage was initiated. Solutions of $AgNO_3$ (3.8 M), NaBr (4.0 M) and a suspension of AgI (Lippmann) were added in proportions to maintain 0.5% iodide out to 95% of growth. No silver iodide was added from 95% to 100% growth. The resulting emulsion was examined by scanning electron microscopy (SEM), and was observed to consist predomintly of hexagonal shaped tabular grains with major faces having 6 edge corners. The median equivalent circular diameter and the median grain thickness of the grains were 1.49 micrometers and 0.07 micrometers respectively as determined by an electron imaging analysis technique.

Epitaxially Sensitized Emulsion E-1a

Silver iodobromide tabular host grain emulsion E-1 was red sensitized using the following finishing procedure that led to the deposition of epitaxy on corners of the silver halide grains. Reported levels are relative to 1 mole of host emulsion. A sample of the emulsion was liquified at 40° C. in a reaction vessel followed by the addition of 2 mole % NaCl, 0.5 mole % AgI (suspension) and 0.5 mole % NaBr. After addition of 0.5 mole % $AgNO_3$, red sensitizing dyes RSD-2 and Benzothiazolium, 5-chloro-2-(2-((5-chloro-3-(2-hydroxy-3-sulfopropyl)-2(3H)-benzothiazolylidene) methyl)-1-butenyl)-3-(2-hydroxy-3-sulfopropyl)—, in ~1:1 mol ratio, were added (~85% grain coverage) and the emulsion was held at 40° C. for 40 minutes. The dopant $K_2Ru(CN)_6$ was then added using a level of 25 μmol. This was followed by the addition of 3.73 mole % NaCl and 0.28 mole % AgI (suspension). After addition of 3.75 mole % $AgNO_3$ over 1 minute and a 15 min hold time, epitaxy was deposited on corners of the silver halide grains. A chemical sensitization was then carried out. Following a 15 min hold time chemical sensitization was carried out. The procedure consisted of introducing 15 μmol of p-actamidophenyl disulfide, 150 mg of NaSCN, 10 μmol of 1-carboxymethyl-1,3,3-trimethyl-2thiourea (sodium salt), 1.67 μmol of Au-1-[3-(2-sulfo)benzamidophenyl]-5-mercaptotetrazole, 10 μmol of 1-(3-acetamidophenyl)-5-mercaptotetrazole, and 35 mmol of 3,5-disulfocatechol (sodium salt). After addition of the sensitizing materials, the emulsion was heated to 55° C. for 15 minutes. Then, 480 μmol of 1-(3-acetamidophenyl)-5-mercaptotetrazole was added at 40° C.

Ultrathin Epitaxially Sensitized Emulsion E-1b

The same procedure as outlined for E-1a was used with the additional step of adding of adding 60, mol of toluene thiosulfonate (per mol of host emulsion silver) before introducing the spectral sensitizing dyes.

A more uniform deposition of the relatively low molar percent nominal $AgCl_{0.93}I_{0.07}$ epitaxy at the majority of emulsion grain corners resulted from addition of the thiosulfonate compound prior to the epitaxial deposition in accordance with the invention. This was confirmed using a TEM procedure to determine the number of grain corners with epitaxial deposition. The results are outlined in Table 1.

TABLE 1

TEM Analysis of Thin Tabular Grains

| Emulsion E-1b Grains treated with thiosulfonate compound | | Emulsion E-1a Grains without thiosulfonate compound | |
|---|---|---|---|
| # of corners w/ epitaxy | Percentage of grains | # of corners w/ epitaxy | Percentage of grains |
| 6 | 36 | 6 | 4 |
| 5 | 33 | 5 | 6 |
| 4 | 19 | 4 | 14 |
| 3 | 8 | 3 | 17 |
| 2 | 2 | 2 | 29 |
| 1 | 1 | 1 | 27 |
| 0 | 1 | 0 | 3 |

As indicated in Table 1, comparison Emulsion E-1a had a fairly broad distribution of grains having depositions on from 1 to 6 corners, while the majority of grains contained epitaxially depositions on just 1 or 2 of the six corners of the grains. Emulsion E-1b epitaxially sensitized in accordance with the invention, on the other hand, had a majority of grains having epitaxial depositions on a majority of grain corners, and clearly demonstrated a more uniform pattern of epitaxial depositions, with a relatively narrow distribution with respect to number of grains having depositions at all (i.e., 6) or most (e.g. 5) of the grain corners.

Emulsion Layers Coating Format

The single emulsion layer coating structure for this example is describe below. Component laydowns are provided in units of $g/m^2$.

A cellulose acetate photographic film support with Rem Jet™ back side antihalation layer was coated with a single emulsion layer of the following composition: red sensitized ultrathin tabular emulsion E-1a or E-1b (silver at 0.807, gelatin at 1.08), dual coated with gelatin based (2.15) cyan dye-forming couple CC-1 (1.61) dispersion.

The single emulsion layer was overcoated with a gelatin (2.15) overcoat layer, to provide a total gelatin coating coverage of (5.38). The hardener 1,1'-oxybis (methylesulfonyl))bis-ethene was added in the overcoat 1.75% of total gelatin weight.

Exposure, Processing and Photographic Measurements

Spectral exposures for the single layer coatings were made with 5500 K daylight using a 21-step granularity tablet with a Wratten 23A filter for 1/100 sec. The exposed strips were then developed in a C41 process for 160 sec. Minimum density (D-min), red speed (measured at 0.15 above minimum density), contrast, and maximum density (D-max) were measured, with the results indicated in Table 2 below.

TABLE 2

Photographic comparisons

| Emulsion | D-min | Speed | Contrast | D-max |
|---|---|---|---|---|
| E-1a (comparison) | 0.087 | 354 | 2.51 | 3.03 |
| E-1b (invention) | 0.074 | 351 | 2.87 | 3.12 |

The photographic results show that the emulsion with thiosulfonate compound added prior to epitaxial deposition having a more uniform epitaxial deposition at the corners of the grains advantageously has a higher contrast, higher D-max, and lower D-min, with comparable speed.

Multilayer Coating Format

The multilayer film structure which may be utilized with emulsions in accordance with the invention is shown below, with structures of components immediately following. Component laydowns are provided in units of $g/m^2$. 1,1'-(oxybis (methylenesulfonyl))bis-ethene hardener is present at 1.6% of total gelatin weight. Antifoggants (including 4-hydroxy-6-methyl-1,3,3a,7-tetraazaindene), surfactants, coating aids, coupler solvents, emulsion addenda, sequesterants, lubricants, matte and tinting dyes are added to the appropriate layers as is common in the art. "Lippmann" refers to an unsensitized fine grain silver bromide emulsion of 0.05 $\mu$m diameter.

Layer 1 (Protective Overcoat Layer): gelatin (0.89).

Layer 2 (UV Filter Layer): silver bromide Lippman emulsion (0.215), UV-1 (0.097), UV-2 (0.107), CFD-1 (0.009), and gelatin (0.699).

Layer 3 (Fast Yellow Layer): a blend of two blue sensitized (with a mixture of BSD-1 and BSD-2) tabular silver iodobromide emulsions (i) 2.7×0.13 micrometer, 4.1 mole % iodide (0.312) and (ii) 1.3×0.14 micrometer, 4.1 mole % iodide (0.312); yellow dye-forming coupler YC-1 (0.258), IR-1 (0.086), bleach accelerator releasing coupler B-1 (0.005) and gelatin (0.915).

Layer 4 (Slow Yellow Layer): a blend of three blue sensitized (all with a mixture of BSD-1 and BSD-2) tabular silver iodobromide emulsions (i) 1.3×0.14 micrometer, 4.1 mole % iodide (0.323), (ii) 0.8×0.14 micrometer, 1.5 mole % iodide (0.355), and (iii) 0.5×0.08 micrometer, 1.5 mole % iodide (0.182); yellow dye-forming couplers YC-1 (0.699) and YC-2 (0.430), IR-1 (0.247), IR-2 (0.022), bleach accelerator releasing coupler B-1 (0.005), and gelatin (2.30).

Layer 5 (Interlayer): OxDS-1 (0.075), A-1 (0.043), and gelatin (0.538).

Layer 6 (Fast Magenta Layer): a green sensitized (with a mixture of GSD-1 and GSD-2) silver iodobromide tabular emulsion, 1.3×0.13 micrometer, 4.5 mole % iodide (0.775); magenta dye-forming coupler MC-1 (0.102), masking coupler MM-1 (0.032), IR-3 (0.036), IR-4 (0.003) and gelatin (1.03).

Layer 7 (Mid Magenta Layer): a blend of two green sensitized (with a mixture of GSD-1 and GSD-2) silver iodobromide tabular emulsions (i) 0.8×0.12 micrometer, 4.5 mole % iodide (0.71) and (ii) 0.7×0.11 micrometer, 4.5 mole % iodide (0.151); magenta dye-forming coupler MC-1 (0.247), masking coupler MM-1 (0.118), IR-3 (0.027), IR-5 (0.024), and gelatin (1.45).

Layer 8 (Slow magenta layer): a blend of three green sensitized (all with a mixture of GSD-1 and GSD-2) silver iodobromide emulsions (i) 0.7×0.11 micrometer tabular, 4.5 mole % iodide (0.172), (ii) 0.5×0.11 micrometer tabular, 4.5 mole % iodide (0.29), and (iii) 0.28 micrometer cubic, 3.5 mole % iodide (0.29); magenta dye-forming coupler MC-1 (0.430), masking coupler MM-1 (0.108), IR-5 (0.031) and gelatin (1.52).

Layer 9 (Interlayer): YFD-1 (0.043), A-1 (0.043), OxDS-1 (0.081) and gelatin (0.538).

Layer 10 (Fast Cyan layer): red-sensitized ultrathin tabular silver iodobromide emulsion E1-b (0.860); cyan dye-forming couplers CC-1 (0.199), IR-6 (0.043), IR-7 (0.059), masking coupler CM-1 (0.027), and gelatin (1.62).

Layer 11 (Mid Cyan Layer): a blend of two red-sensitized (both with a mixture of RSD-1, RSD-2, and RSD-3) silver iodobromide tabular emulsions (i) 1.2×0.11 micrometer, 4.1 mole % iodide (0.344) and (ii) 1.0×0.11 micrometer, 4.1 mole % iodide (0.430), cyan dye-forming coupler CC-1 (0.344), IR-2 (0.038), masking coupler CM-1 (0.016), and gelatin (1.13).

Layer 12 (Slow cyan layer): a blend of two red sensitized (both with a mixture of RSD-1, RSD-2, and RSD-3) tabular silver iodobromide emulsions (i) 0.7×0.12 micrometer, 4.1 mole % iodide (0.484) and (ii) 0.5×0.08 micrometer, 1.5 mole % iodide (0.646); cyan dye-forming coupler CC-1 (0.583), IR-7 (0.034), masking coupler CM-1 (0.011), bleach accelerator releasing coupler B-1 (0.086) and gelatin (1.92).

Layer 13 (Interlayer): OxDS-1 (0.075) and gelatin (0.538).

Layer 14 (Antihalation layer): Black Colloidal Silver (0.151), OxDS-1 (0.081), and gelatin (1.61).

Support: annealed poly(ethylene naphthalate)

Chemical Structures

UV-1

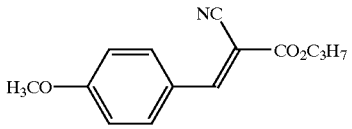

UV-2

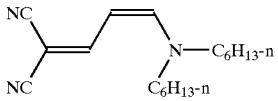

YC-1

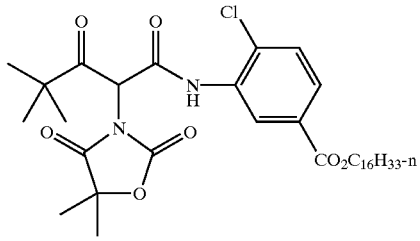

-continued

YC-2

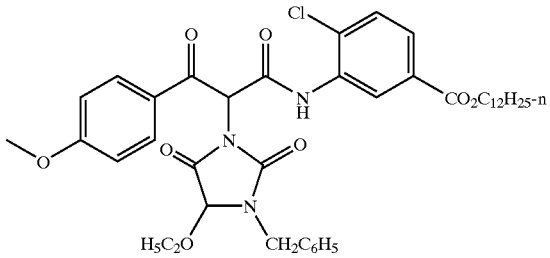

IR-1

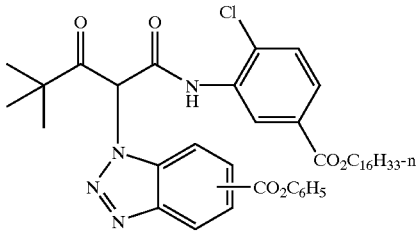

IR-2

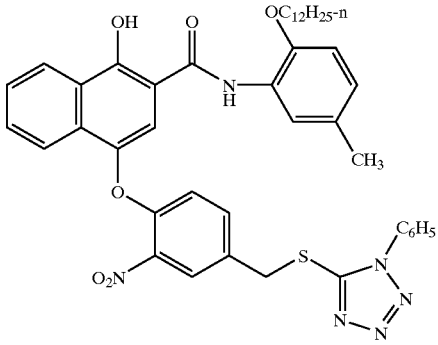

B-1

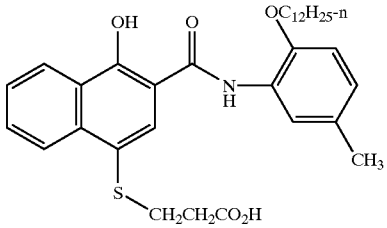

BSD-2

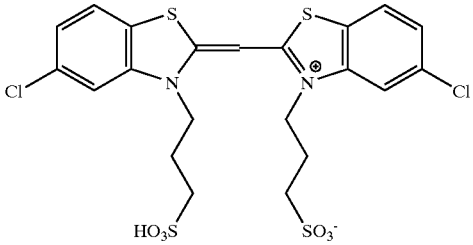

-continued
BSD-1
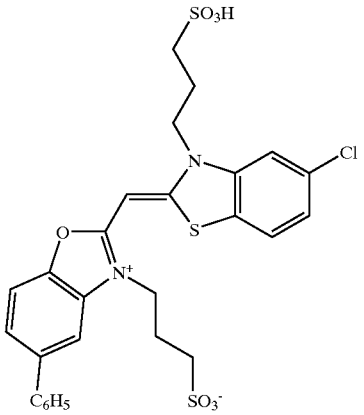
YFD-1
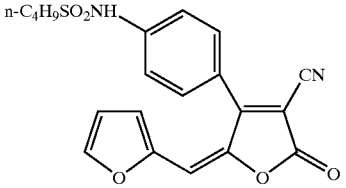
OxDS-1
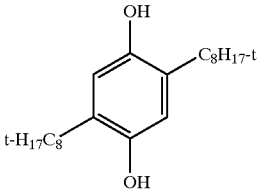
A-1
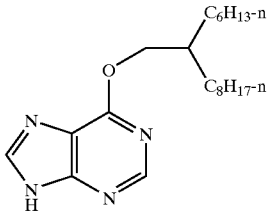
GSD-2
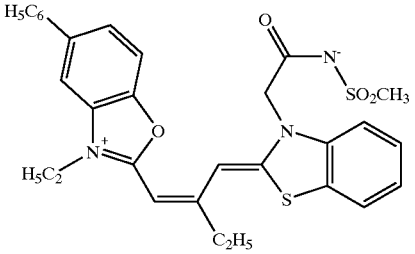
GSD-1
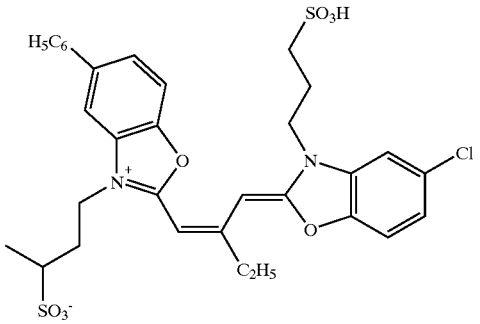
-continued
MC-1
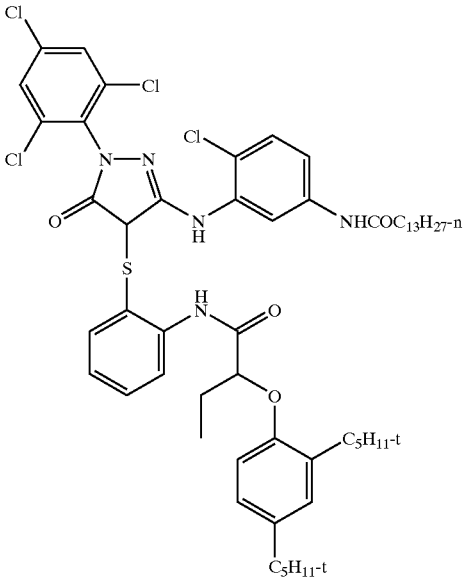
MM-1
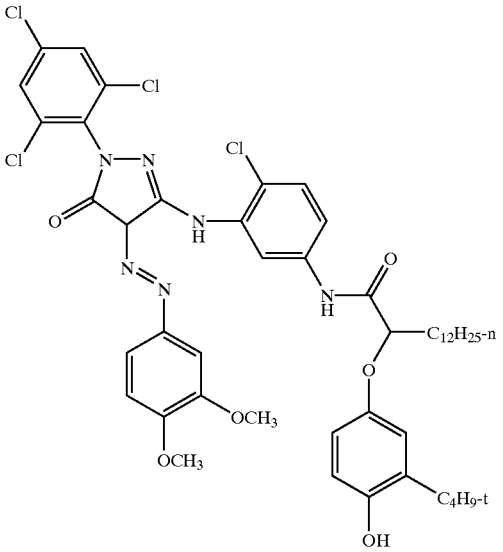
IR-3
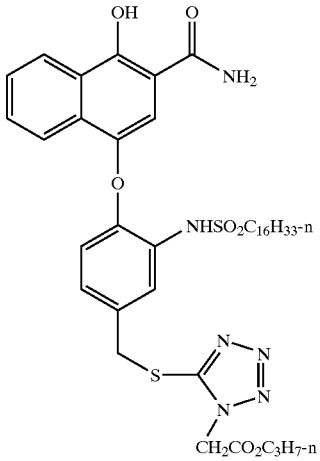

-continued
IR-5
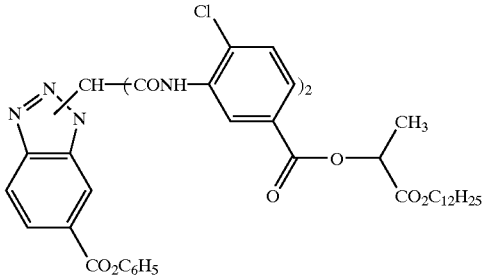
IR-4
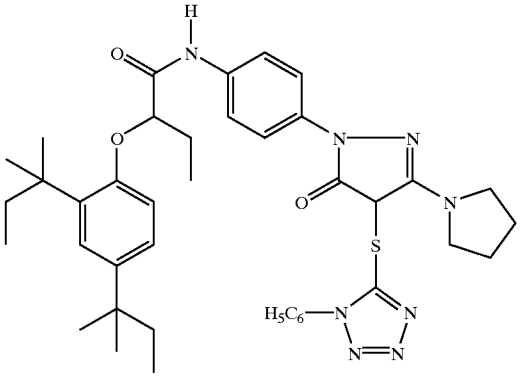
RSD-1
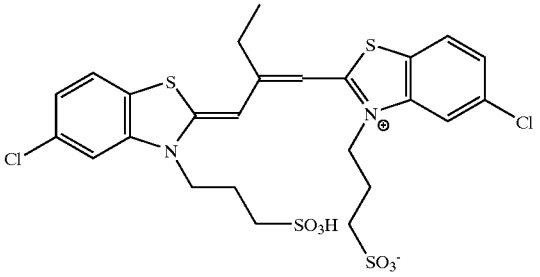
RSD-2
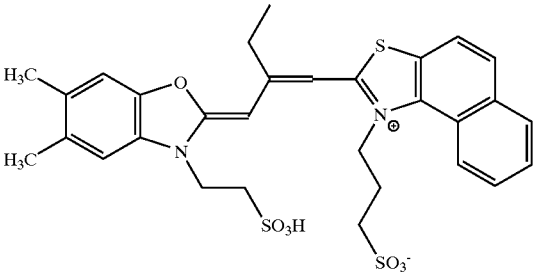
RSD-3
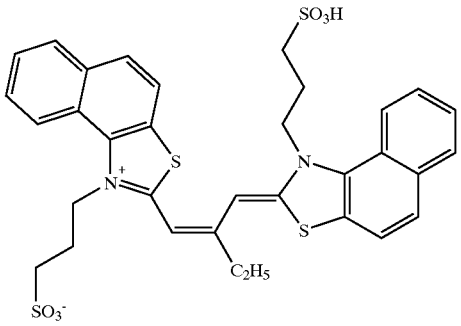
-continued
CC-1
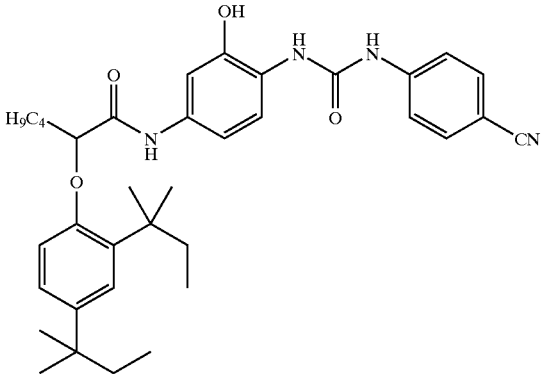
CFD-1
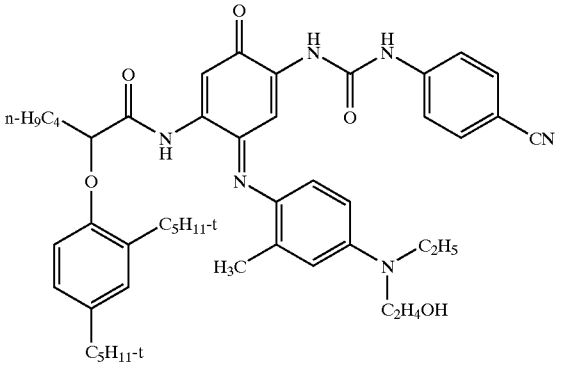
IR-6
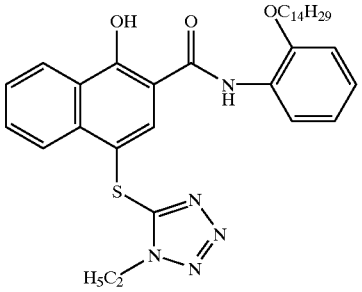
IR-7
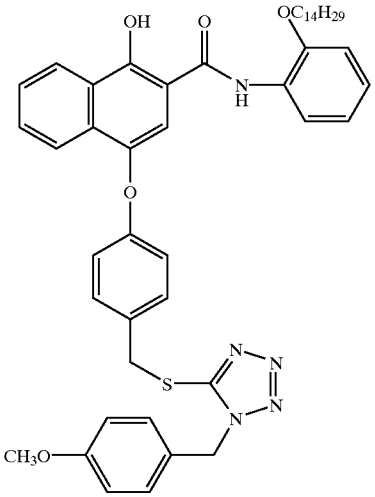

-continued

CM-1

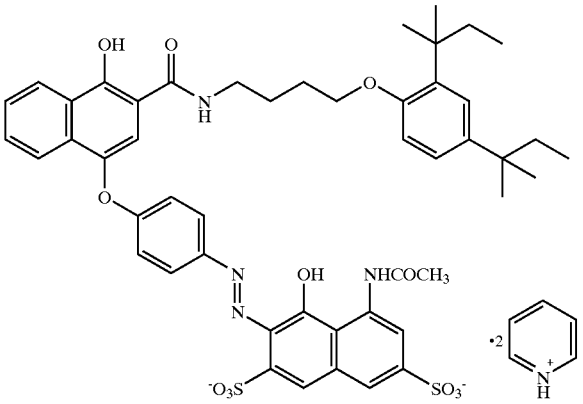

The invention has been described in detail with particular reference to preferred embodiments thereof, but it will be understood that variations and modifications can be effected within the spirit and scope of the invention.

What is claimed is:

1. A process of sensitizing a tabular grain emulsion containing the sequential steps of (i) providing a tabular grain host emulsion comprised of a dispersing medium and silver halide grains including tabular grains having {111} major faces and an aspect ratio of at least 2, which contain greater than 50 mole percent bromide, based on silver, and which account for greater than 50 percent of total grain projected area, (ii) adding a thiosulfonate compound of the following Formula I at the surface of the tabular grains of the host emulsion:

$$Z^1SO_2SZ^2 \quad \text{(I)}$$

where $Z^1$ represents is a substituted or unsubsituted aliphatic, aromatic, or heterocyclic group, and $Z^2$ represents a substituted or unsubsituted aliphatic, aromatic, or heterocyclic group, or a monovalent metal or organic cation, where $Z^1$ and $Z^2$ may combine together to form a ring structure or either of $Z^1$ or $Z^2$ may comprise a polymeric backbone wherein the thiosulfonate group may be repeated; and (iii) adding silver and halide ions, where the halide ions include at least chloride ions, to the tabular grain host emulsion in an amount of from 0.5–7 mole percent based on total silver of the tabular grain host emulsion to precipitate silver halide protrusions forming epitaxial junctions with up to 50 percent of the surface area of the tabular grains essentially at only the corners of the tabular grains, the protrusions having an isomorphic face centered cubic crystal structure and including at least a 10 mole percent higher chloride ion concentration than the host tabular grains.

2. A process according to claim 1 wherein the host tabular grains contain at least 0.25 mole % iodide.

3. A process according to claim 2, wherein iodide ions are also added during step (iii) such that the protrusions include an iodide concentration that is increased by the iodide ion addition.

4. A process according to claim 3 wherein bromide ions are introduced during step (iii) to increase the proportion of the iodide ions introduced into the tabular grain emulsion that are incorporated into the epitaxially deposited protrusions.

5. A process according to claim 1, wherein the epitaxially deposited silver halide protrusions comprise from 1–6 mole percent based on total silver of the host tabular grains.

6. A process according to claim 1, wherein the epitaxially deposited silver halide protrusions comprise from 3–6 mole percent based on total silver of the host tabular grains.

7. A process according to claim 1 wherein a spectral sensitizing dye capable of acting as a site director is adsorbed to the surfaces of the tabular grains after step (ii) and prior to the formation of the epitaxial junctions at the corners of the tabular grains.

8. A process according to claim 1, wherein silver halide epitaxy is restricted to less than 25 percent of the host grain surface area.

9. A process according to claim 1, wherein silver halide epitaxy is restricted to less than 10 percent of the host grain surface area.

10. A process according to claim 1, wherein silver halide epitaxy is restricted to less than 5 percent of the host grain surface area.

11. A process according to claim 1, wherein $Z^2$ represents a monovalent metal or tetraalkylammonium cation.

12. A process according to claim 11, wherein $Z^1$ represents a toluene group.

13. A process according to claim 1, wherein the compound of Formula I is added to the host emulsion in an amount not more than about 10,000 $\mu$mol per mole of silver in the host grain emulsion.

14. A process according to claim 13, wherein the compound of Formula I is added to the host emulsion in an amount from about 1 to 1000 $\mu$mol per mole of silver in the host grain emulsion.

15. A process according to claim 13, wherein the compound of Formula I is added to the host emulsion in an amount from about 10 to 500 $\mu$mol per mole of silver in the host grain emulsion.

16. A radiation-sensitive emulsion comprised of (i) a dispersing medium (ii) silver halide grains including host tabular grains having {111} major faces and an aspect ratio of at least 2, which contain greater than 50 mole percent bromide, based on silver, and which account for greater than 50 percent of total grain projected area, (iii) a thiosulfonate compound of the following formula (1):

$$Z^1SO_2SZ^2 \quad \text{(I)}$$

where $Z^1$ represents is a substituted or unsubsituted aliphatic, aromatic, or heterocyclic group, and $Z^2$ represents a substituted or unsubsituted aliphatic, aromatic, or heterocyclic group, or a monovalent metal or organic cation, where $Z^1$ and $Z^2$ may combine together to form a ring structure or either of $Z^1$ or $Z^2$ may comprise a polymeric backbone wherein the thiosulfonate group may be repeated, (iv) a spectral sensitizing dye adsorbed to the surfaces of the tabular grains, and (v) latent image forming chemical sensitization sites on the surfaces of the tabular grains comprising epitaxially deposited silver halide protrusions exhibiting an isomorphic face centered cubic crystal lattice structure and containing a silver chloride concentration at least 10 mole percent higher than that of the tabular grains, wherein the epitaxial protrusions comprise from 0.5–7 mole percent based on total silver of the host tabular grains and form epitaxial junctions with up to 50 percent of the surface area of the tabular grains and at the majority of corners of the tabular grains.

17. An emulsion according to claim 16 wherein the host tabular grains contain greater than 70 mole percent bromide and at least 0.25 mole percent iodide, based on silver.

18. An emulsion according to claim 17 wherein the tabular grains account for greater than 90 percent of total grain projected area.

19. An emulsion according to claim 16, wherein the epitaxially deposited silver halide protrusions comprise from 1–6 mole percent based on total silver of the host tabular grains.

20. An emulsion according to claim 16, wherein the epitaxially deposited silver halide protrusions comprise from 3–6 mole percent based on total silver of the host tabular grains.

21. An emulsion according to claim 16 where the epitaxially deposited silver halide protrusions are located on less than 10 percent of the host tabular grain surface are.

22. An emulsion according to claim 16, wherein $Z^2$ represents a monovalent metal or tetraalkylammonium cation.

23. An emulsion according to claim 21, wherein $Z^1$ represents a toluene group.

24. A photographic element comprised of a support, and a silver halide emulsion layer coated on the support comprised of an emulsion according to claim 16.

* * * * *